US005189899A

United States Patent [19]

Hsu

[11] Patent Number: 5,189,899

[45] Date of Patent: Mar. 2, 1993

[54] APPARATUS FOR VEHICLE STRAIGHTENING AND REPAIR

[76] Inventor: Chin H. Hsu, Suite 1, 11F, 95-8 Chang Ping Road, Sec. 1, Taichung, Taiwan

[21] Appl. No.: 823,848

[22] Filed: Jan. 22, 1992

[51] Int. Cl.[5] ..... B21D 12/00

[52] U.S. Cl. ..... 72/457; 72/705; 269/60

[58] Field of Search ..... 72/457, 705; 269/45, 269/60

[56] References Cited

U.S. PATENT DOCUMENTS

| | | | |
|---|---|---|---|
| 4,238,951 | 12/1980 | Grainger et al. | 72/705 |
| 4,289,016 | 9/1981 | Hare | 72/705 |
| 4,463,937 | 8/1984 | Celette | 72/705 |

*Primary Examiner*—Lowell A. Larson

[57] ABSTRACT

A vehicle repair and alignment apparatus for correcting and aligning misshapened vehicle frames and outer body panels comprises a frame having a pair of elongate track members with slotted rails provided along the outer edges thereof, vertical pull towers pivotably mounted on a respective semicircular platen slidingly engaged on each rail enabling selective angular orientation of the pull towers with respect to the track members, and two pairs of vertical bolster cylinders powerably positionable in both horizontal directions within the track members each having clamp elements provided on the upper ends thereof for anchoring the vehicle to the apparatus. Horizontal displacements of the bolster cylinder pairs are effected remotely by actuating electric motors while vertical motion of the clamp elments are accomplished by fluid lifters. Proximity sensors on each clamp element automatically signal the limits of vertical motion when a body portion on the underside of the vehicle is within grasp.

2 Claims, 10 Drawing Sheets

APPARATUS FOR VEHICLE STRAIGHTENING AND REPAIR

BACKGROUND OF THE PRESENT INVENTION

The present invention relates to an apparatus for correcting and aligning misshapened vehicle frame and body portions, and more particularly to apparatus of the type having a pair of parallel elongate track members for supporting a vehicle in an elevated position and at least one pull tower carrying pulleys and a flexible connector for exerting pulling forces on various portions of the vehicle, selectively positionable along the outer side of each track member.

Though similar apparatus are known from the prior art, e.g. U.S. Pat. No. 4,794,783 (Eck, 1989) and U.S. Pat. No. 4,151,737 (Specktor, 1979), hitherto, to the best knowledge of the inventor, none provide a rapid and largely automated method of securing the vehicle frame or body so as to firmly resist the counter forces subjected to it during the alignment or straightening process.

While bolster means have been disclosed in the prior art, they were usually limited to manually positioned rod like elements which were individually secured to the underside of a vehicle and cooperating receiving spaces in the supporting frame. Aside from inconvenience of the amount of time required for the operation, an operator would have to position himself under the vehicle body and placement of the bolster rods were limited to the positions of available receiving spaces on the support frame.

SUMMARY OF THE PRESENT INVENTION

The present invention has a main objective of providing an apparatus for straightening or aligning misshapened or displaced vehicle body parts or frame members comprising a structural frame including a pair of parallel track members for supporting a vehicle with at least one pull tower slidingly mounted on each track member for exerting pulling forces on selected portions of the vehicle that are also adjustable in angle therewith, and two pairs of vertical bolster cylinders powerably positionable under the vehicle body under the remote control of an operator, having clamps on the terminal ends thereof for clamping to selected frame or panel portions on the underside of the vehicle.

A secondary objective of the present invention is to provide each clamp element with a proximity sensor for detecting contact or eminent contact with the selected vehicle frame or panel portion and effect the stoppage of vertical displacement of the bolster cylinder which is fluid actuated.

Further objects and advantages of the present invention will become apparent with reference to the detailed description of a preferred embodiment provided below along with accompanying drawings.

A BRIEF DESCRIPTION OF THE DRAWINGS

DETAILED DESCRIPTION OF A PREFERRED EMBODIMENT

Figure 1:
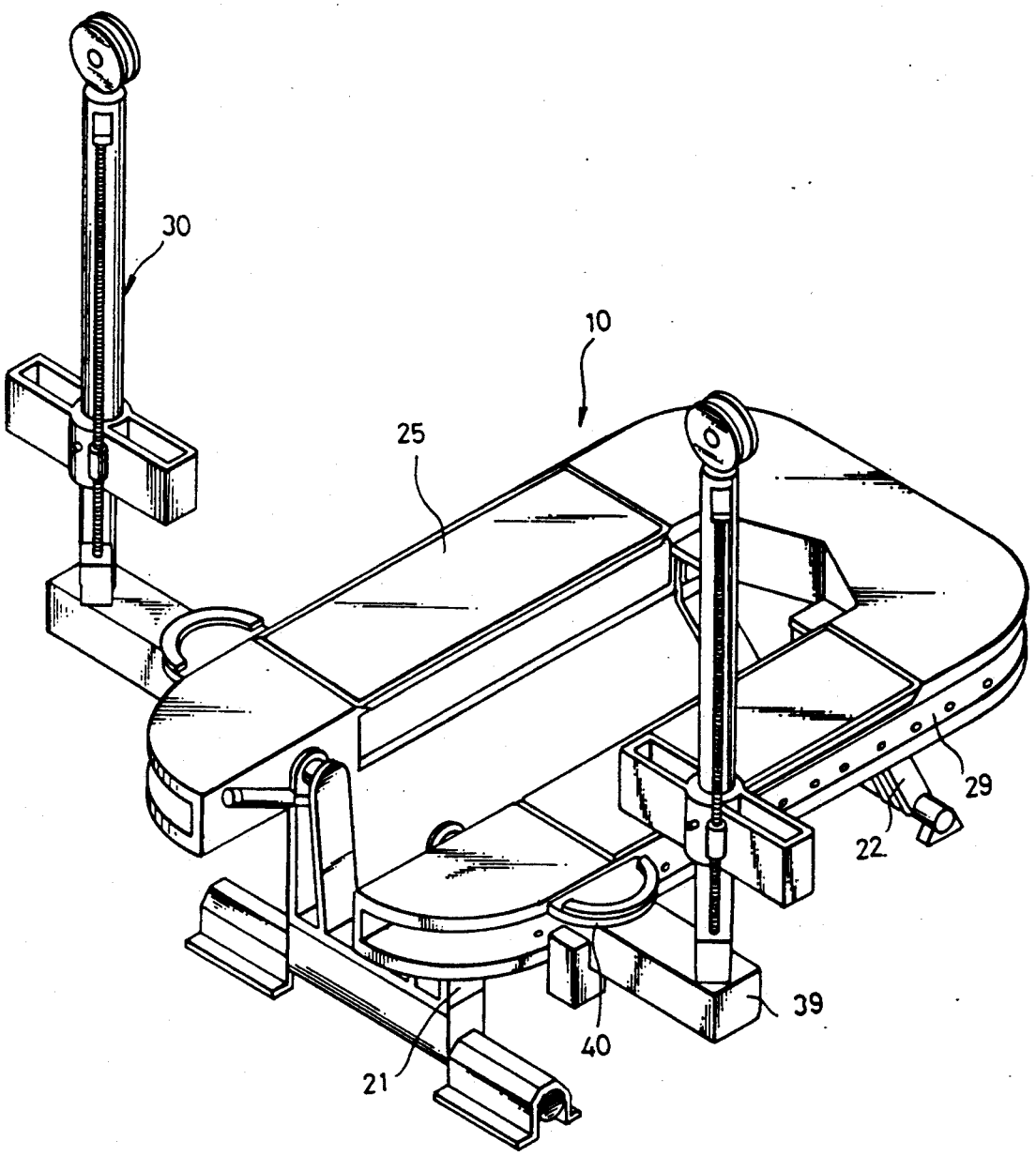
FIG. 1 is a perspective view of the vehicle repair apparatus of the present invention.

Referring to FIG. 1, a preferred embodiment of the vehicle repair and straightening apparatus of the present invention comprises a generally U-shaped frame 10 supported by a pair of lift scissors 21 and 22 disposed below opposing end portions thereof, and a pair of vertical pull towers 30 disposed to either side of the frame adjacent to respective parallel elongate track members 25 thereof onto which a vehicle is positioned. Each pull tower 30 is pivotably secured to a semicircular platen 40 via a pivot arm 39 so as to be rotatable about a parallel axis concentric with the platen. The platens 40 in turn are slidingly engaged with a respective recessed guide rail 29 formed around the outer periphery of each track member 25. As is discussed further below, the pull towers can thus be selectively positioned along a respective guide rail 29 and used to exert a pulling force on a vehicle part in a direction of choice via a flexible connector.

Figure 2:
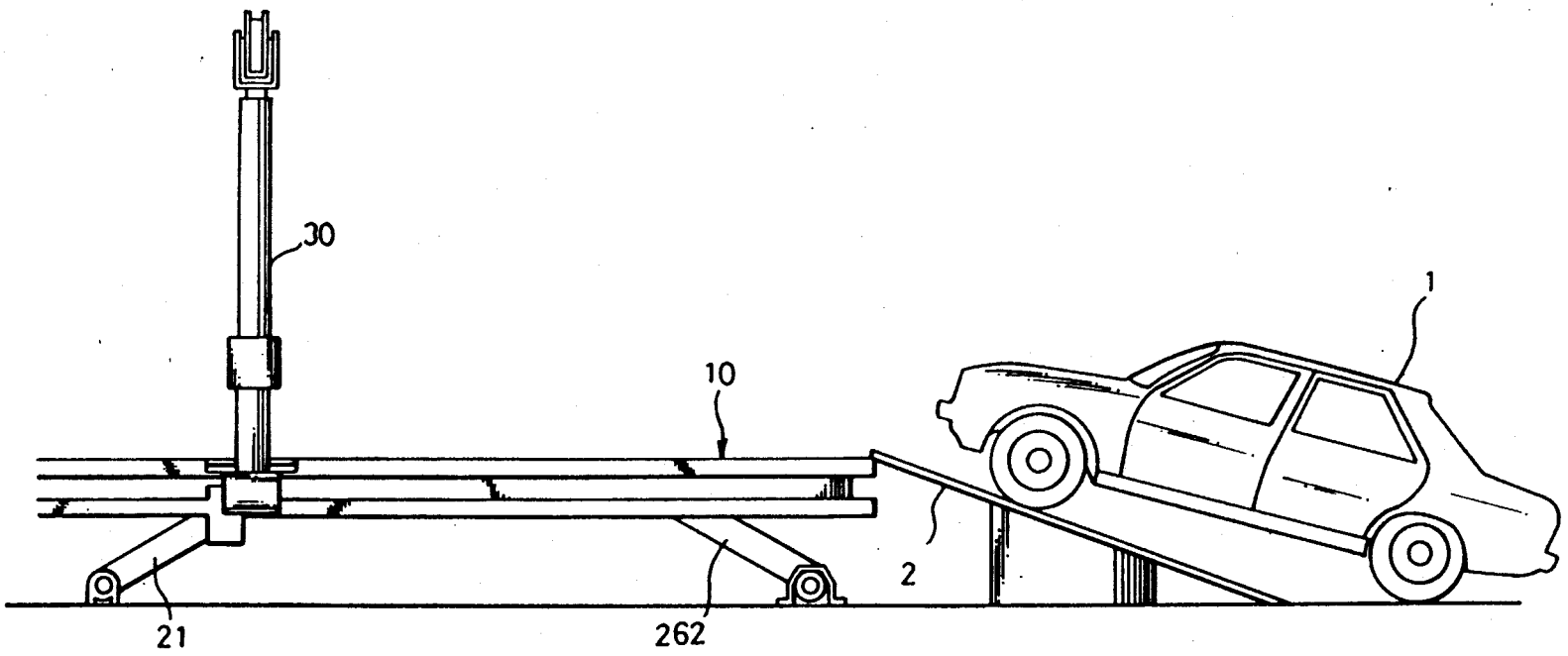
FIG. 2 is a side view showing a vehicle being driven onto the apparatus via a ramp to the rear thereof.
Figure 3:
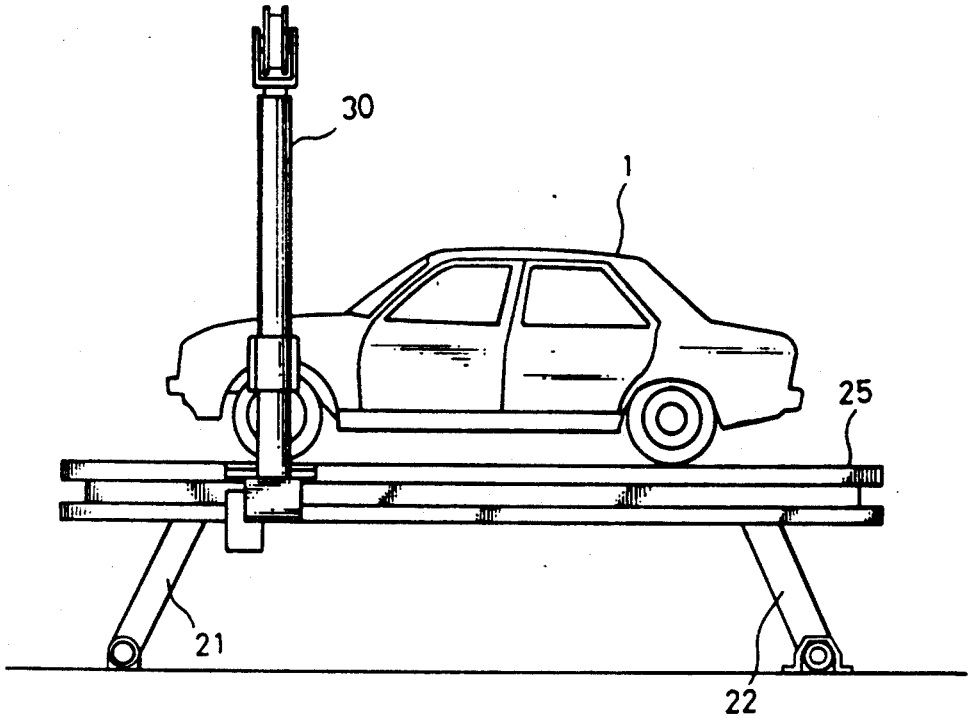
FIG. 3 is a side view showing a vehicle in raised position on the apparatus.
Figure 4:
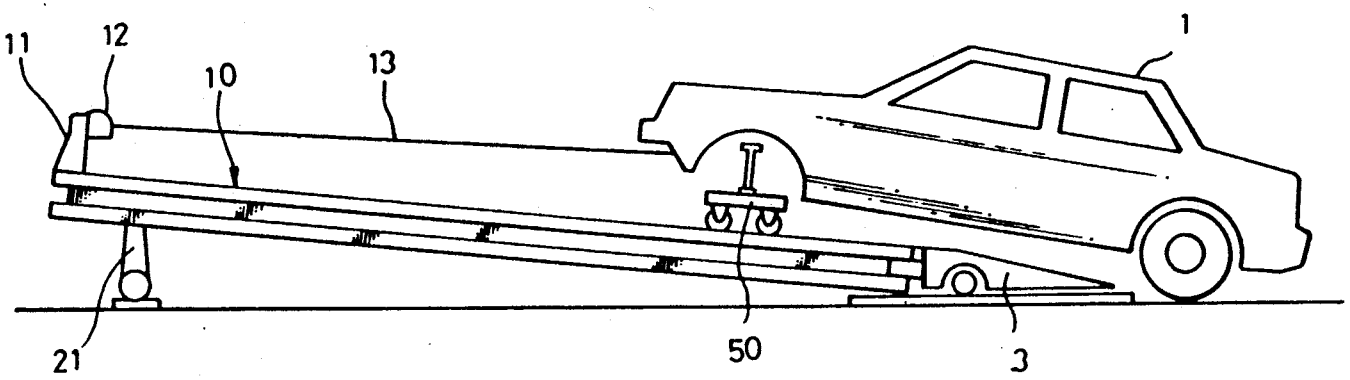
FIG. 4 is a side view of a vehicle with the front wheels thereof missing and replaced by a trolley, being pulled forward onto the apparatus.
Figure 5:
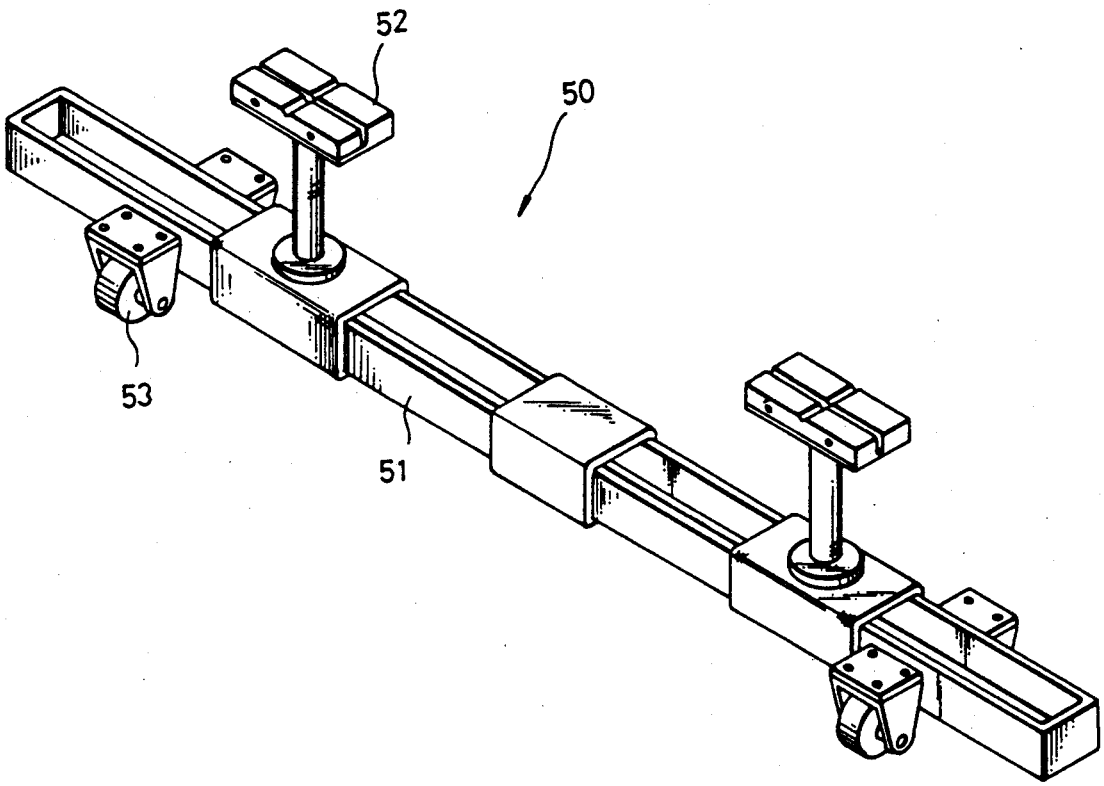
FIG. 5 is a perspective view of the wheeled support trolley of FIG. 4.

Referring to FIGS. 2 to 4, prior to actual work on a vehicle's body or frame a vehicle can be raised onto frame 10 using a variety of methods. In a first exemplary method, a vehicle 1 travels under its own power up a ramp 2 onto the elevated frame 10 wherein both lift scissors 21,22 are in a raised position, as shown in FIG. 2. FIG. 3 shows the vehicle positioned over the track members 25 after the operation is completed. A second exemplary method, as depicted in FIG. 4, has a vehicle 1 with the front wheels thereof missing being drawn up frame 10 which is inclined with the floor by a winch 12. The winch is secured to a post 11 disposed on the elevated end of the frame wherein only lift scissor 21 is in a raised position with the front of the vehicle being pulled by cable 13. The front of the vehicle is supported by wheeled trolleys 50 disposed in the wheel wells thereof so that the vehicle can be rolled up the track members. A small ramp 3 enables the trolley supported vehicle to engage the initial step at the rear of frame 10. FIG. 5 shows a trolley 50 in close up, comprising an elongate bar 51, a pair of support pads 52 disposed on the top of vertical rods extending from the bar 51, and two pairs of castor wheels 53 disposed on respective sides thereon.

Figure 6:
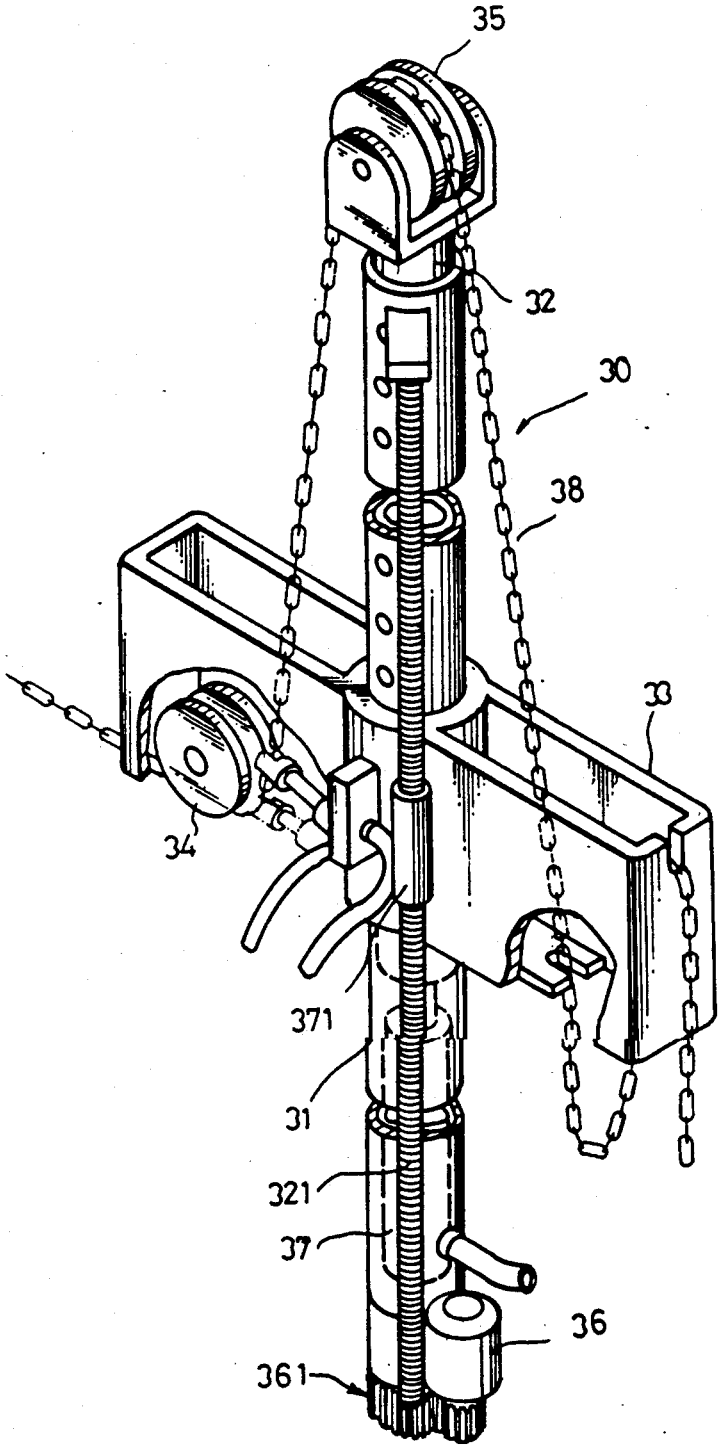
FIG. 6 is a perspective view of a pull tower.

Referring to FIG. 6, each pull tower 30 comprises a sleeve member 31 with a telescoping ram 32 disposed therein, and a hollow cross member 33 slidingly engaged on sleeve 31. A first wing of cross member 33 carries a first pulley wheel 34 while a second pulley wheel 35 is disposed on the upper end of ram 32. The position of cross member 33 on sleeve 31 can be adjusted by remotely actuating a motor 36 through a control system. The motor 36 rotates a threaded shaft 37 through gears 361 causing vertical displaements of the cross member which is engaged with threaded shaft 37 through a nut 371 fixed thereon. In operation, a flexible connector such as chain 38 would pass around pulleys 34 and 35 and have one terminal end releasably secured to a second wing of cross member 33 and a second terminal end thereof secured to a vehicle part. Tension would then be exerted on chain 38 by the upwards bias of ram 32 effected by a hydraulic cylinder 321 disposed thereunder within sleeve 31. Requisite pulling forces could thus be exerted on the attached vehicle part.

Figure 7:
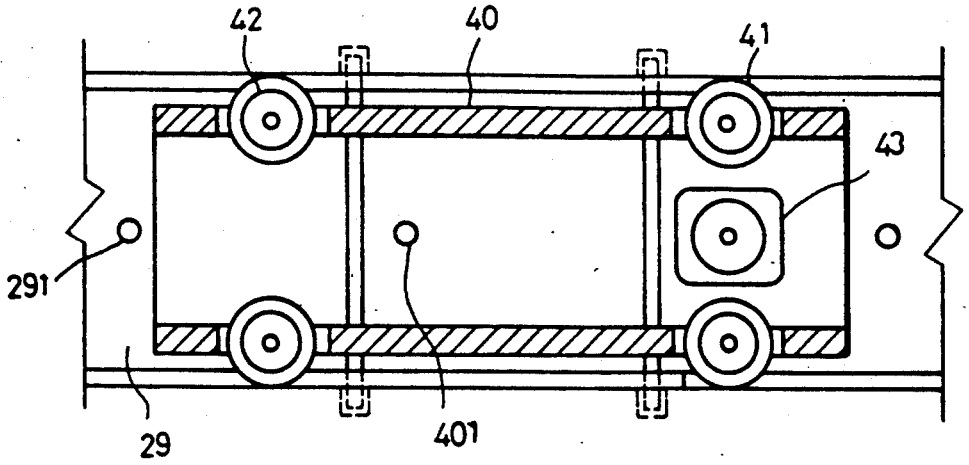
FIG. 7 is a sectional view showing the sliding engagement of a semicircular platen on a guide rail.
Figure 8:
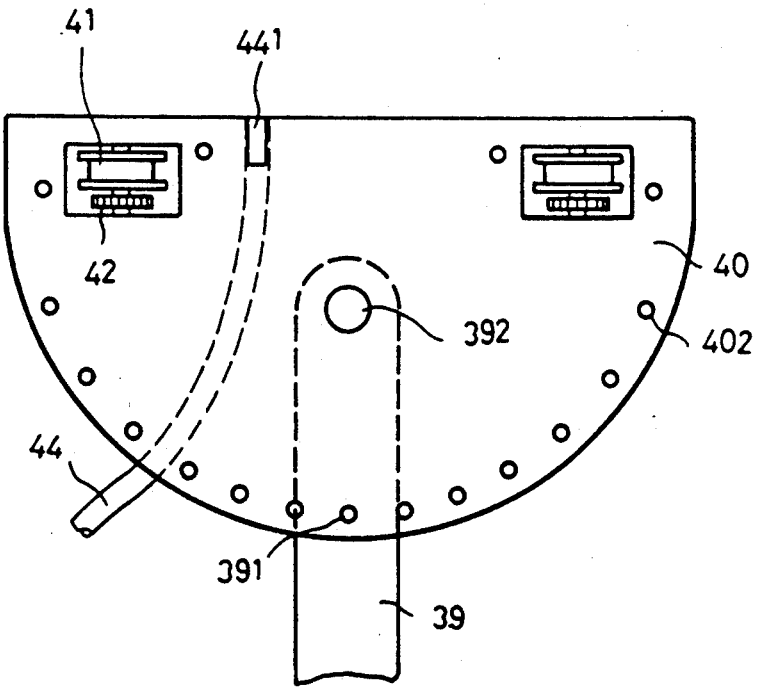
FIG. 8 is a top view of the semicircular platen.

As shown in FIG. 7, each semicircular platen 40 is slidingly engaged with a respective guide rail 29 by a set of four flanged wheels 41 disposed in platen 40 near the flat side thereof and parallel therewith having rolling engagement with opposing inner sides of the guide rails. A remotely controlled electric motor 43 drives the two upper wheels 41 via coaxial sprocket wheels 42 and a chain 421. A series of through holes 291 are formed on the inner wall of each guide rail 29 at predetermined positions thereon for positioning of the platen 40. In operation, the control system would actuate the drive motor 43 to effect displacement of the platen until a through hole 401 formed on the flat side thereof was brought into registry with a selected positioning hole 291 on the guide rail. A pin 441, as shown in FIG. 8, would then be driven into the two holes 401 and 291 by an impulse from pneumatic hose 44 locking platen 40 in the desired position along guide rail 29. Similarly, a series of through holes 402 are formed around the periphery of each platen 40 at predetermined positions thereon for the angular positioning of pivot arm 39 which carries a pull tower 30. Pivot arm 39 can be rotated about axle 392 until a through hole 391 is in registry with a selected hole 402 on the platen and a pin inserted therein to lock the two in a desired angular orientation.

Figure 9:
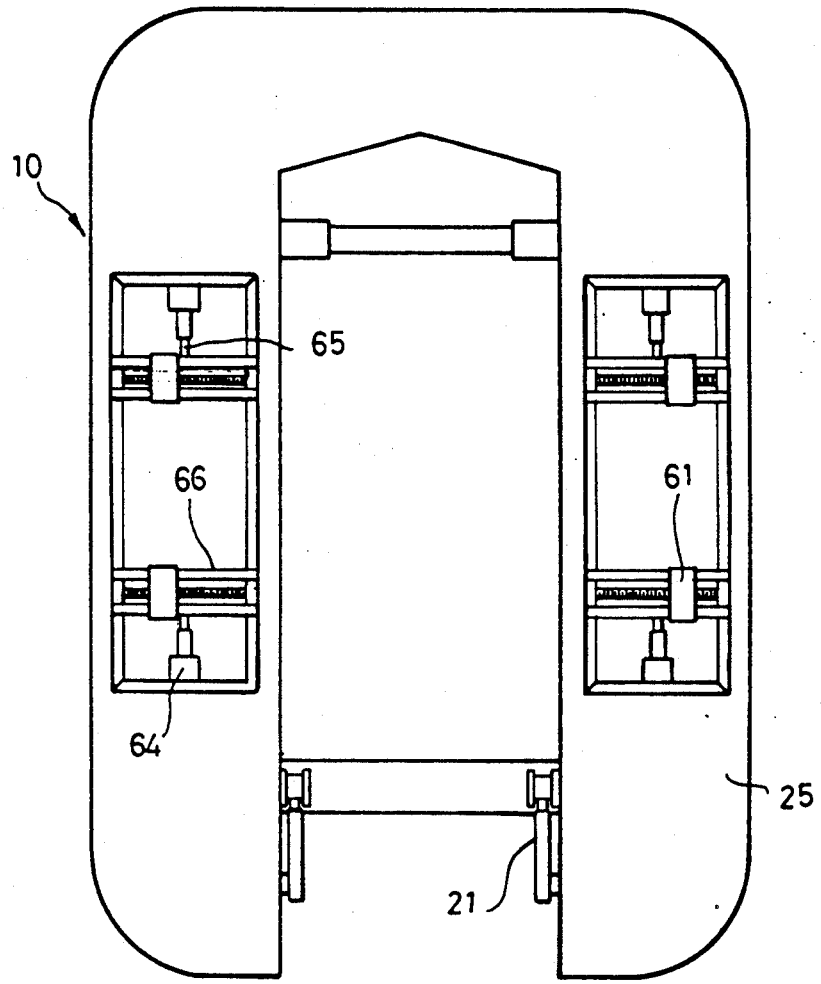
FIG. 9 is a top view showing the longitudinal displacement mechanism of a pair of bolster cylinders.
Figure 10:
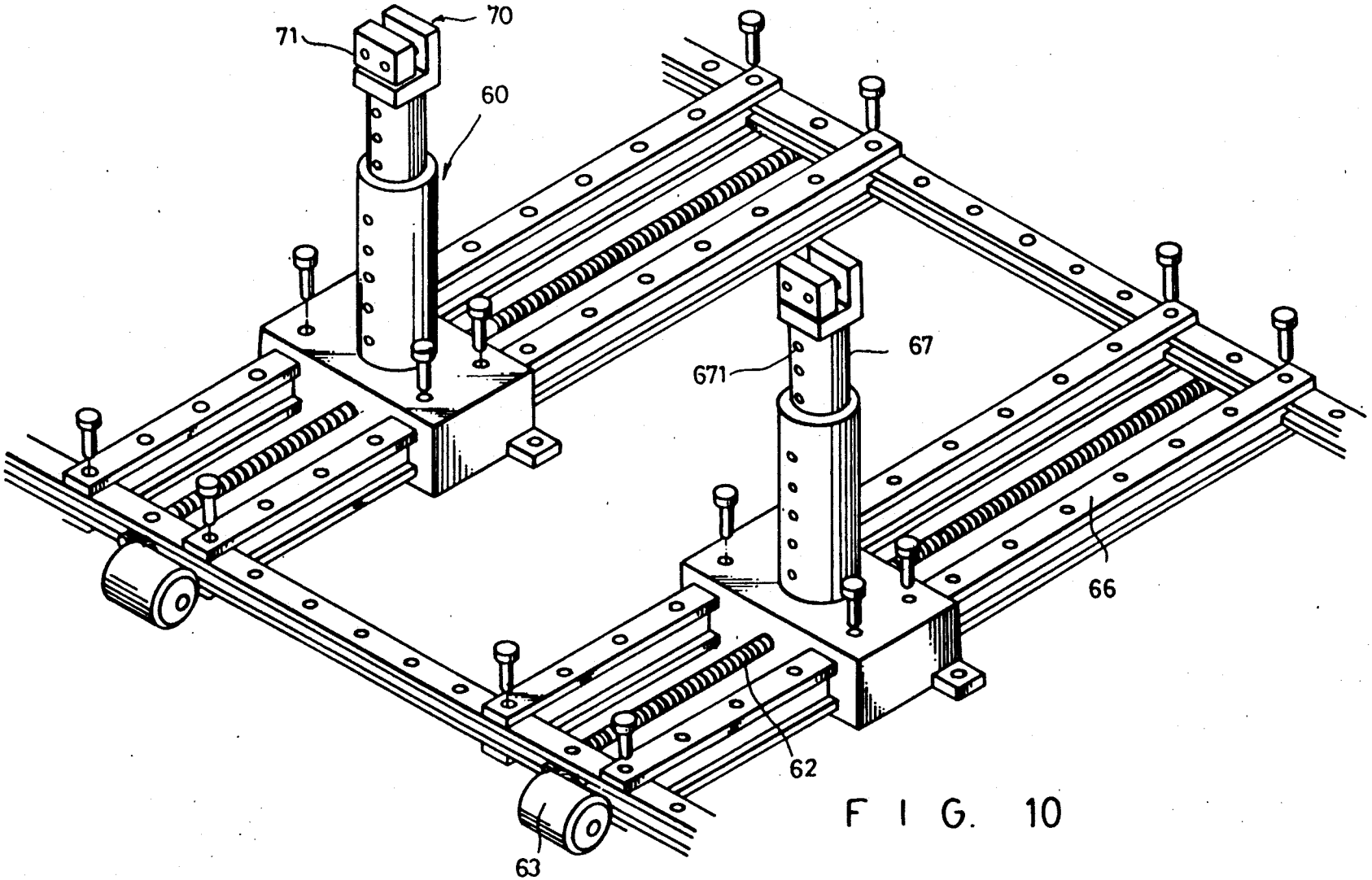
FIG. 10 is a perspective view showing the lateral displacement mechanism of the pair of bolster cylinders.

Referring to FIGS. 9 and 10, a pair of positionable vertical bolster cylinders 60 are provided in each track member 25 for firmly securing a panel or frame portion on the underside of a vehicle. Each bolster cylinder 60 is carried by a support block 61 riding on a threaded shaft 62 which when rotated by a motor 63 under the control of the control system displaces the bolster cylinder to a desired lateral position under the vehicle body, as shown in FIG. 10. Longitudinal positioning of each individual bolster cylinder 60 is similarly accomplished by respective motors 64 and threaded shafts 65, as in FIG. 9, which effect displacements of the lateral carriages 66. Each bolster cylinder 60 comprises a pair of telescoping sleeve members 67 having a fluid lifter therein which also being remotely controlled effects vertical extensions of the cylinder and the clamp member 70 on the upper terminal end thereof. Both sleeves 67 have a series of through holes 671 formed longitudinally thereon which when brought into registry can be inserted with a pin to firmly secure the selected position.

Each clamp 70 has a proximity sensor 71 disposed on the movable jaw thereof which signals to the control system that the desired vehicle portion or component is within grasp which subsequently stops further upward displacement of the bolster cylinder 60 and effects the fluid powered closure of the clamp member 70 so as to firmly secure the vehicle portion and resist counterforces from the pulling forces exerting by corresponding pull towers 30.

Figure 11:
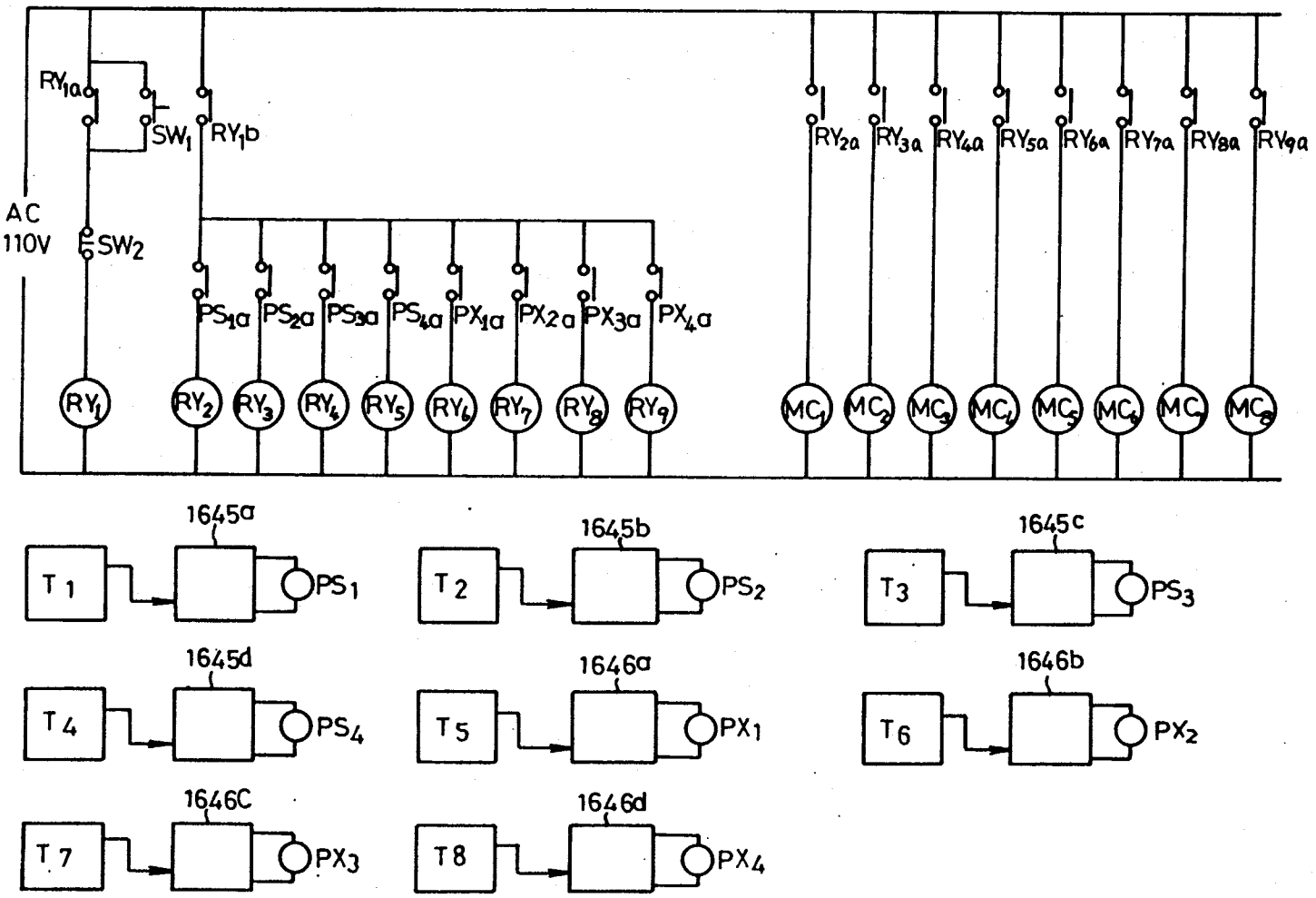
FIG. 11 is a schematic diagram of the control system controlling the various motions of the apparatus.

FIG. 11 shows a schematic diagram of the electric and fluid circuits used in the control system for actuating the various motors and hydraulic or pneumatic cylinders used to effect the various motions of the apparatus. As it would be readily apparent to one of average skill in the art that such a control system could readily actualize the requisite functions of the apparatus no further details in regards therewith will be discussed herein.

Though the above description contains many specificaties these should not be construed as limitations on the scope of the present invention but merely as one mode of actualization of a preferred embodiment thereof with the actual spirit and scope being determined by the appended claims and their legal equivalents.

I claim:

1. An improvement on apparatus for straightening and repairing vehicles of the type comprising a frame member having a pair of parallel elongate track members for supporting a vehicle, and at least one vertical pull tower adjustable in position along the outer side of each said track member and being adjustable in angular orientation with respect therewith for exerting pulling forces on selected vehicle parts connected therewith, wherein in the improvement thereof:

at least two vertical bolster cylinders are disposed over each said track member, each said bolster cylinder being carried by a support block slidingly mounted on a laterally aligned carriage with each said support block being displaceable by a threaded shaft engaged therewith, said threaded shaft being rotated by a remotely controlled motor;

each said carriage is slidingly engaged within a corresponding said track member, each said carriage being displaceable in a longitudinal direction by a threaded shaft engaged therewith, said threaded shaft of a said carriage being rotated by a corresponding remotely controlled motor;

each said bolster cylinder has a sleeve member with a telescoping extension therein displaceable in a vertical direction by a remotely controlled fluid lifting means disposed within said sleeve;

a clamp member is provided on the upper terminal end of said extension of each said bolster cylinder for securing with a selected vehicle part.

2. An improvement on an apparatus for vehicle straightening and repair according to claim 1, further comprising a proximity sensor carried on each said clamp member for detecting contact or eminent contact with a vehicle part, signaling a control system to stop further upward displacement of said extension of said bolster cylinder and initiate closure of said clamp member.

* * * * *